US007793918B2

(12) United States Patent
Newman

(10) Patent No.: US 7,793,918 B2
(45) Date of Patent: Sep. 14, 2010

(54) METHOD AND SYSTEM FOR GOVERNING BLOCK SPEED

(75) Inventor: Frederic M. Newman, Midland, TX (US)

(73) Assignee: Key Energy Services, LLC, Houston, TX (US)

( * ) Notice: Subject to any disclaimer, the term of this patent is extended or adjusted under 35 U.S.C. 154(b) by 378 days.

(21) Appl. No.: 11/850,391

(22) Filed: Sep. 5, 2007

(65) Prior Publication Data

US 2009/0057630 A1 Mar. 5, 2009

(51) Int. Cl.
*B66D 1/50* (2006.01)

(52) U.S. Cl. ..... 254/267

(58) Field of Classification Search ..... 254/267, 254/269, 270, 271, 273; 166/205.01, 53
See application file for complete search history.

(56) References Cited

U.S. PATENT DOCUMENTS 3,648,166 A 8/1972 Krueger ..... 235/200 R
7,226,037 B2 * 6/2007 Newman ..... 254/274
2005/0114001 A1 5/2005 Newman ..... 701/50
2005/0120785 A1 6/2005 Shin ..... 73/114.37
2005/0199388 A1 9/2005 Newman ..... 166/250.01
2006/0163545 A1 7/2006 Newman ..... 254/267
2007/0056746 A1 3/2007 Newman ..... 166/383
2007/0089878 A1 4/2007 Newman ..... 166/255.1
2007/0129976 A1 * 6/2007 Hochberg et al. ..... 705/7

* cited by examiner

*Primary Examiner*—Emmanuel M Marcelo
(74) *Attorney, Agent, or Firm*—King & Spalding LLP

(57) ABSTRACT

A task input is received at a well service rig. The maximum allowable speed is determined for the task. Current block speed inputs are received. The throttle position for the engine controlling the block is evaluated to determine if the block is to be sped up or slowed down. When the throttle position indicates the operator is attempting to speed up the block, the current block speed is compared to the maximum allowable speed and the engine is only allowed to speed up the block up to the maximum allowable speed, at which point the operators control of block speed is limited to reducing block speed. Each task can have multiple maximum allowable speeds, which can vary based on specified conditions. When the hookload is light or the remaining equipment in the well is small, the lock-up feature for the transmission can be disengaged in addition to the block speed governing feature.

25 Claims, 10 Drawing Sheets

METHOD AND SYSTEM FOR GOVERNING BLOCK SPEED

FIELD OF THE INVENTION

The present invention generally pertains to equipment used for drilling, preparing, repairing, and evaluating wells. More specifically the present invention pertains to methods and systems for governing the speed of a block based on the tasks to be performed at the well.

BACKGROUND OF THE INVENTION

After drilling a hole through a subsurface formation and determining that the formation can yield an economically sufficient amount of oil or gas a crew completes the well. Once completed, a variety of events may occur to the formation causing the well and its equipment to require a "work-over." For purposes of this application, "work-over" and "service" operations are used in their very broadest sense to refer to all activities performed on or for a well to repair or rehabilitate the well, and also includes activities to shut in or cap the well. Generally, workover operations include such things as replacing worn or damaged parts (e.g., a pump, sucker rods, tubing, and packer glands), applying secondary or tertiary recovery techniques, such as chemical or hot oil treatments, cementing the wellbore, and logging the wellbore, to name just a few.

During drilling, completion, and well servicing, personnel routinely insert into and/or extract equipment such as tubing, tubes, pipes, rods, hollow cylinders, casing, conduit, collars, and duct from the well. For example, a service crew may use a workover or service rig (collectively hereinafter "service rig" or "rig") that is adapted to, among other things, pull the well tubing or rods and also to run the tubing or rods back into the well. Typically, these mobile service rigs are motor vehicle-based and have an extendible, jack-up derrick complete with draw works and block. The crew may inspect the extracted tubing and evaluate whether one or more sections of that tubing should be replaced due to physical wear, thinning of the tubing wall, chemical attack, pitting, or other defects. The crew typically replaces sections that exhibit an unacceptable level of wear and note other sections that are beginning to show wear and may need replacement at a subsequent service call.

During rod or tubing removal, a rig operator typically lifts a stand of tubing (or rods) which is then held in place by slips (or elevators for rods) while the stand is separated from the remaining portion of the tubing or rod string in the well. Once the stand of tubing has been separated from that which is still in the well, the stand of tubing can be placed on a tubing board. During conventional lifting operations, the rig operator has a full range of control of the speed at which the tubing or rods are lifted out of the well. With this, operators have a tendency to want to remove the rods, tubing or other equipment out of the well as quickly as possible in order to complete the job in a timely manner. However, by removing equipment from the well at a speed that is too high, the opportunities for damaging the well, the equipment, and the workers around the well dramatically increases.

In addition, as the stands of tubing (or rods) are being pulled out of the well, the total amount of weight on the string is reduced and the length of the string is reduced. When there are only a few stands of tubing left in the well, pulling the tubing out at a typical rate of speed, can become more dangerous because, if the tubing snags or drags in the well, there is less overall elasticity within the remaining length of tubing, and therefore, less time to react to problems caused by the hang-up in the well. This too can cause dangerous conditions around the wellhead.

Furthermore, during logging operations or when the equipment, such as tubing, is being inspected within the well the inspection data can be misleading if the logging equipment or the tubing (when the logging equipment is stationary) is being pulled too quickly, thereby limiting the usefulness of the inspection data.

Therefore, there is a need in the art for a system and method for monitoring the block speed for a rig during a pulling or running operation and limiting the maximum allowable speed of the block, thereby limiting the speed of the equipment that is attached to the hook of the rig. Furthermore, what is needed is a method and apparatus for evaluating the task being completed by a rig and the hookload and/or rig load to determine if the speed of the block should be limited to a maximum allowable speed. Furthermore what is needed in the art is a method for evaluating the task being completed by a rig and the amount of equipment remaining in the well to determine if the speed of the block should be limited to a maximum allowable speed. In addition, what is needed in the art is a system and method for disabling the lock-up system for a transmission driving the block when the hookload is light or only a small portion of the equipment, such as tubing, remains in the well during a pulling operation.

The present invention is directed to solving these as well as other similar issues in the well service area.

SUMMARY OF THE INVENTION

A method for governing the speed of a block based on the task that is being completed can include receiving a task input at a well service rig. The maximum allowable speed can be determined based on the task. An encoder or other speed evaluating device can provide an input for the current block speed as it accomplishes the task. The throttle position for the engine controlling the block can be evaluated to determine if the block is to be sped up or slowed down. When the throttle position indicates the operator is attempting to speed up the block, the current block speed can be compared to the maximum allowable speed. If the current speed is below the maximum allowable speed but the change would increase it above the maximum allowable speed, the signal to the engine can be managed to limit the block's velocity up to the maximum allowable speed, at which point the operators control of block speed is limited to reducing block speed. If the current speed is below the maximum allowable speed and the change would not increase the block speed above the maximum allowable speed, the operator can be allowed to maintain full control of the block speed through the throttle controls. Each task can have multiple maximum allowable speeds, which can vary based on specified conditions, such as hookload, rig load, or the amount of equipment remaining in the well. In addition, when the hookload is light or the remaining equipment in the well is small, the lock-up feature for the transmission can be disengaged in addition to the block speed governing feature.

For one aspect of the present invention, a method for controlling the speed of a block on a well service rig can include receiving the block speed from a speed analysis device. An input for the current position of the throttle, through which the rig operator controls the speed of the engine and thereby the speed of the block, can be accepted. An evaluation of the throttle input can be conducted to determine if the operator is attempting to increase the block speed above a maximum allowable speed. The maximum allowable speed can be input by the operator or stored within a computer, processor or analysis device. The block speed can then be limited to the maximum allowable speed if the input for the current position of the throttle would have raised the block speed above the maximum allowable speed.

For another aspect of the present invention, a method for controlling block speed can include an input for the task to be completed being accepted at a speed evaluation computer or processor at the well service rig. A maximum allowable speed can be determined or calculated based on the received task at the speed evaluation computer. An input for the throttle position and the current block speed can be accepted at the speed evaluation computer. An evaluation of the throttle input can be conducted to determine if the operator is attempting to increase the block speed above a maximum allowable speed. The block speed can then be limited to the maximum allowable speed if the input for the current position of the throttle would have raised the block speed above the maximum allowable speed.

For yet another aspect of the present invention, a method for controlling block speed on a well service rig can include an input for the task to be completed being accepted at a speed evaluation computer at the well service rig. A predetermined hookload weight can be stored in or received at the speed evaluation computer. A maximum allowable speed can be determined or calculated based on the received task and the predetermined hookload weight at the speed evaluation computer. An input for the throttle position, the current block speed, and the current hookload weight can be accepted at the speed evaluation computer. The speed evaluation computer or another computer can determine if the current hookload weight is equal to or below the predetermined hookload weight. Based on a positive determination that the current hookload weight is equal to or below the predetermined hookload weight, the speed evaluation computer can prevent the throttle input from increasing the block speed above the maximum allowable speed.

For another aspect of the present invention, a system for controlling the speed of a block on a well service rig can include a throttle sensor for determining if the operator is attempting to speed-up or slow-down the engine, and thereby the speed of the block. The system can also include a block speed sensor for determining the current speed of the block. The system can further include a task input display for receiving the task being completed at the well. The system can also include an engine electronic controller for receiving a signal from the throttle sensor or a speed evaluator and converting that into an increase or decrease in speed of the engine, and correspondingly the block as well. The system can also include a speed evaluator, such as a computer or processor, for receiving task, throttle and block speed information and determining if the block is already at or will go above a maximum allowable speed. The speed evaluator can generate a signal to the engine electronic controller that is different from the throttle input and limits the speed of the engine and thereby the speed of the block to the maximum allowable speed.

DETAILED DESCRIPTION OF THE EXEMPLARY EMBODIMENTS

Exemplary embodiments of the invention will now be described in detail with reference to the included figures. The exemplary embodiments are described in reference to how they might be implemented. In the interest of clarity, not all features of an actual implementation are described in this specification. Those of ordinary skill in the art will appreciate that in the development of an actual embodiment, several implementation-specific decisions must be made to achieve the inventors' specific goals, such as compliance with system-related and business-related constraints which can vary from one implementation to another. Moreover, it will be appreciated that such a development effort might be complex and time-consuming, but would nevertheless be a routine undertaking for those of ordinary skill in the art having benefit of this disclosure. Further aspects and advantages of the various figures of the invention will become apparent from consideration of the following description and review of the figures. While references are generally made hereinafter to rods or tubing specifically, with the description of the figures, each reference should be read broadly to include rods, tubing, piping, and other downhole equipment unless specifically limited therein.

Figure 1:
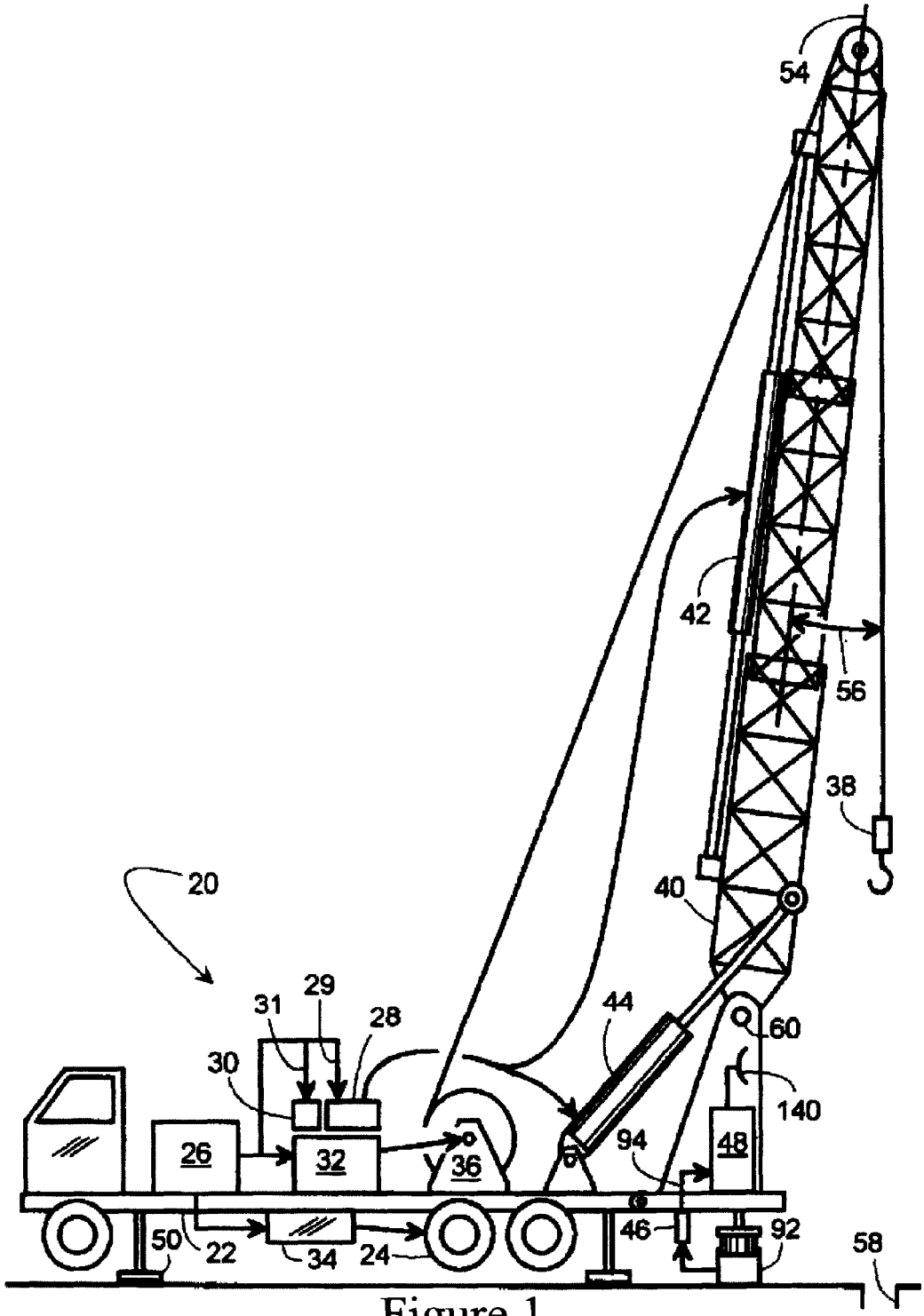
FIG. 1 is a side view of an exemplary mobile repair unit with its derrick extended according to one exemplary embodiment of the present invention.

Referring to FIG. 1, a retractable, self-contained mobile repair unit 20 is presented to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50.

Figure 2:
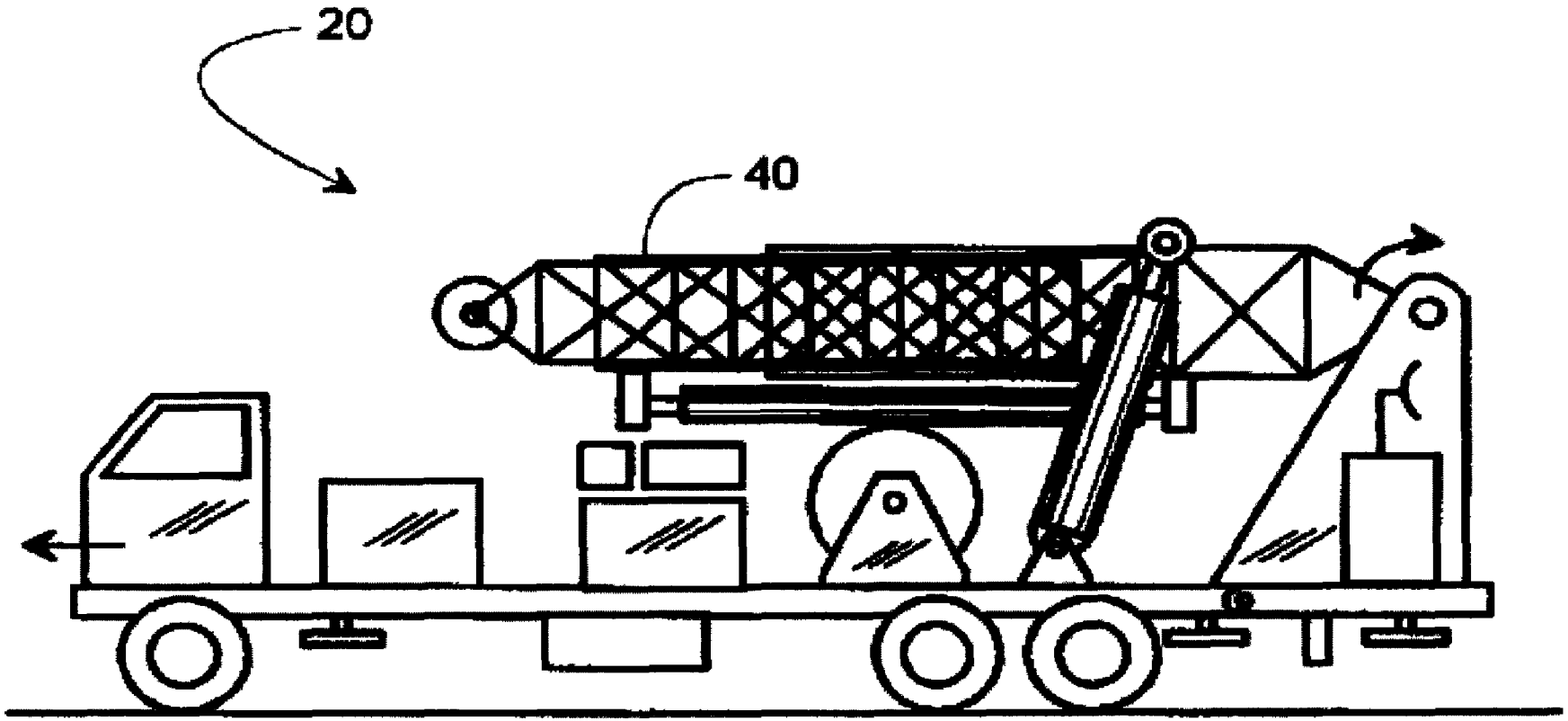
FIG. 2 is a side view of the exemplary mobile repair unit with its derrick retracted according to one exemplary embodiment of the present invention.

The engine 26 selectively couples to the wheels 24 and the hoist 36 by way of the transmissions 34 and 32, respectively. The engine 26 also drives the hydraulic pump 28 via the line 29 and the air compressor 30 via the line 31. The compressor 30 powers a pneumatic slip (Not Shown), and the pump 28 powers a set of hydraulic tongs (Not Shown). The pump 28 also powers the cylinders 42 and 44 which respectively extend and pivot the derrick 40 to selectively place the derrick 40 in a working position, as shown in FIG. 1, and in a lowered position, as shown in FIG. 2. In the working position, the derrick 40 is pointed upward, but its longitudinal centerline 54 is angularly offset from vertical as indicated by the angle 56. The angular offset provides the block 38 access to a wellbore 58 without interference with the derrick pivot point 60. With the angular offset 56, the derrick framework does not interfere with the typically rapid installation and removal of numerous inner pipe segments (known as pipe, inner pipe string, rods, or tubing 62, hereinafter "tubing" or "rods").

Individual pipe segments (of string 62 in FIG. 4) and sucker rods are screwed to themselves using hydraulic tongs. The term "hydraulic tongs" used herein and below refer to any hydraulic tool that can screw together two pipes or sucker rods. An example would include those provided by B. J. Hughes company of Houston, Tex. In operation, the pump 28 drives a hydraulic motor (Not Shown) forward and reverse by way of a valve. Conceptually, the motor drives the pinions which turn a wrench element relative to a clamp. The element and clamp engage flats on the mating couplings of a sucker rod or an inner pipe string 62 of one conceived embodiment of the invention. However, it is well within the scope of the invention to have rotational jaws or grippers that clamp on to a round pipe (i.e., no flats) similar in concept to a conventional pipe wrench, but with hydraulic clamping. The rotational direction of the motor determines assembly or disassembly of the couplings.

While not explicitly shown in the figures, when installing the tubing segments 62, the pneumatic slip is used to hold the tubing 62 while the next segment of tubing 62 is screwed on using tongs. A compressor 30 provides pressurized air through a valve to rapidly clamp and release the slip. A tank helps maintain a constant air pressure. Pressure switch provides the monitor 48 (FIG. 3) with a signal that indirectly indicates that the rig 20 is in operation.

Figure 3:
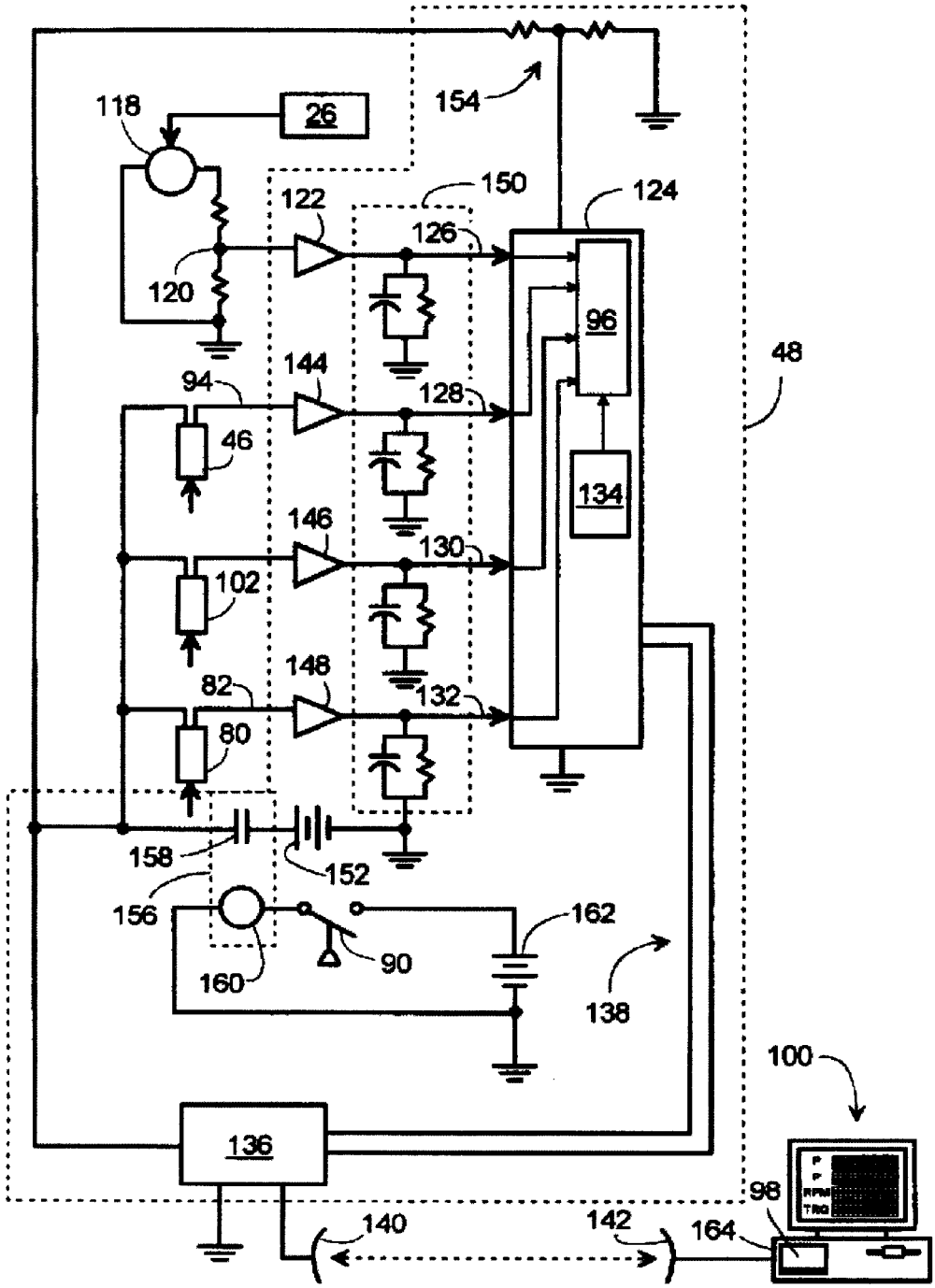
FIG. 3 is an electrical schematic of a monitor circuit according to one exemplary embodiment of the present invention.

Referring back to FIG. 1, weight applied to the block 38 is sensed by way of a hydraulic pad 92 that supports the weight of the derrick 40. The hydraulic pad 92 is basically a piston within a cylinder (alternatively a diaphragm) such as those provided by M. D. Totco company of Cedar Park, Tex. Hydraulic pressure in the pad 92 increases with increasing weight on the block 38. In FIG. 3, the first transducer 46 converts the hydraulic pressure to a 0-5 VDC signal 94 that is conveyed to the monitor 48. The monitor 48 converts signal 94 to a digital value, stores it in a memory 96, associates it with a real time stamp, and eventually communicates the data to a remote computer 100 or the computer 605, of FIG. 6, by way of hardwire, a modem 98, T1 line, WiFi or other device or method for transferring data known to those of ordinary skill in the art.

Returning to FIG. 3, transducers 46 and 102 are shown coupled to the monitor 48. The transducer 46 indicates the pressure on the left pad 92 and the transducer 102 indicates the pressure on the right pad 92. A generator 118 driven by the engine 26 provides an output voltage proportional to the engine speed. This output voltage is applied across a dual-resistor voltage divider to provide a 0-5 VDC signal at point 120 and then passes through an amplifier 122. A generator 118 represents just one of many various tachometers that provide a feedback signal proportional to the engine speed. Another example of a tachometer would be to have engine 26 drive an alternator and measure its frequency. The transducer 80 provides a signal proportional to the pressure of hydraulic pump 28, and thus proportional to the torque of the tongs.

A telephone accessible circuit 124, referred to as a "POCKET LOGGER" by Pace Scientific, Inc. of Charlotte, N.C., includes four input channels 126, 128, 130 and 132; a memory 96 and a clock 134. The circuit 124 periodically samples inputs 126, 128, 130 and 132 at a user selectable sampling rate; digitizes the readings; stores the digitized values; and stores the time of day that the inputs were sampled. It should be appreciated by those skilled in the art that with the appropriate circuit, any number of inputs can be sampled and the data could be transmitted instantaneously upon receipt.

A supervisor at a computer 100 remote from the work site at which the service rig 20 is operating accesses the data stored in the circuit 124 by way of a PC-based modem 98 and a cellular phone 136 or other known methods for data transfer. The phone 136 reads the data stored in the circuit 124 via the lines 138 (RJ11 telephone industry standard) and transmits the data to the modem 98 by way of antennas 140 and 142. In an alternative embodiment the data is transmitted by way of a cable modem or WiFi system (Not Shown). In one exemplary embodiment of the present invention, the phone 136 includes a CELLULAR CONNECTION.™. provided by Motorola Incorporated of Schaumburg, Ill. (a model S1936C for Series II cellular transceivers and a model S1688E for older cellular transceivers).

Figure 4:
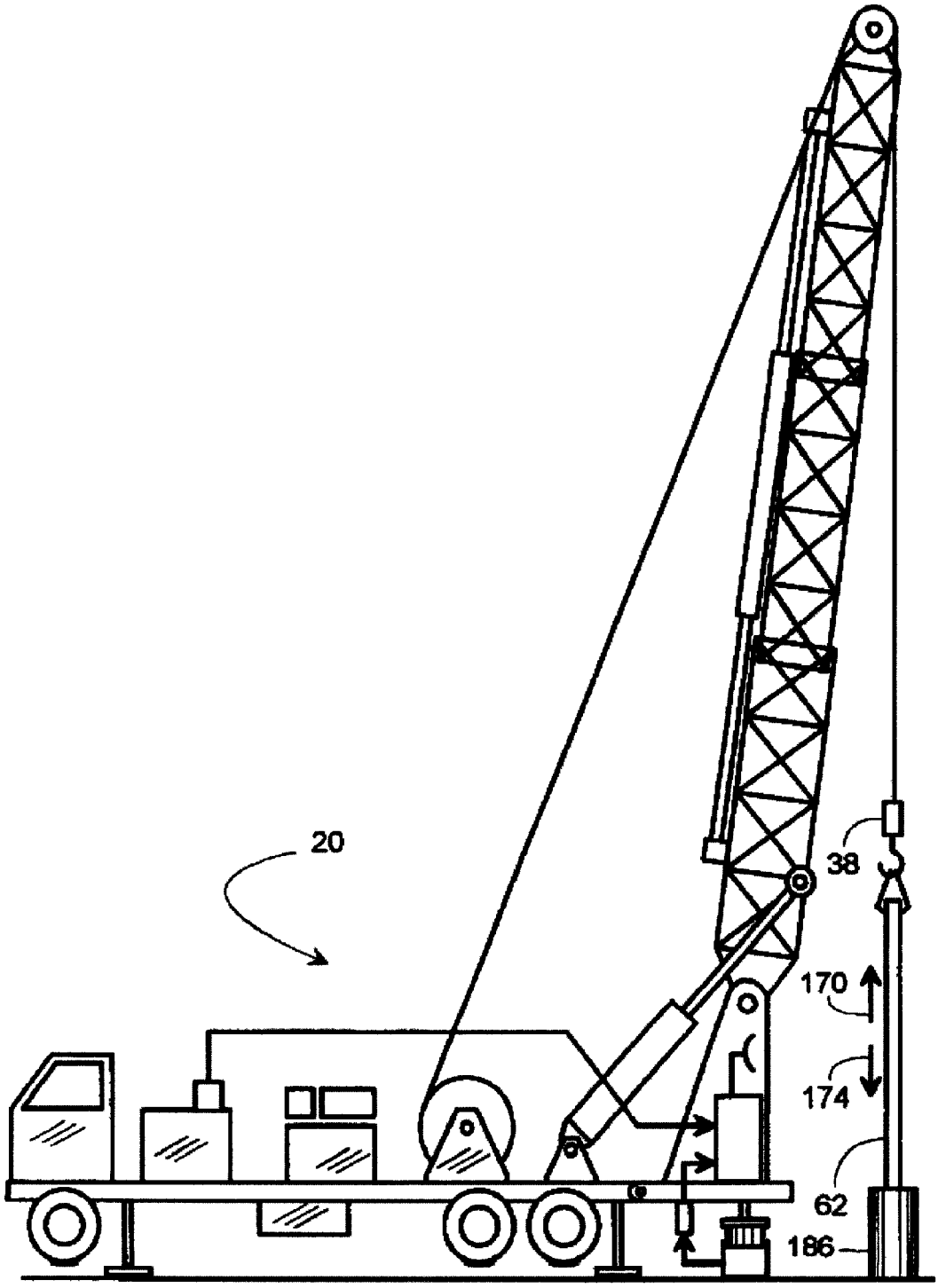
FIG. 4 illustrates the raising and lowering of an inner tubing string with an exemplary mobile repair unit according to one exemplary embodiment of the present invention.

Some details worth noting about the monitor 48 is that its access by way of a modem makes the monitor 48 relatively inaccessible to the crew at the job site itself. However the system can be easily modified to allow the crew the capability to edit or amend the data being transferred. The amplifiers 122, 144, 146 and 148 condition their input signals to provide corresponding inputs 126, 128, 130 and 132 having an appropriate power and amplitude range. Sufficient power is needed for RC circuits 150 which briefly (e.g., 2-10 seconds) sustain the amplitude of inputs 126, 128, 130 and 132 even after the outputs from transducers 46, 102 and 80 and the output of the generator 118 drop off. This ensures the capturing of brief spikes without having to sample and store an excessive amount of data. A DC power supply 152 provides a clean and precise excitation voltage to the transducers 46, 102 and 80; and also supplies the circuit 124 with an appropriate voltage by way of a voltage divider 154. A pressure switch 90 enables the power supply 152 by way of the relay 156, whose contacts 158 are closed by the coil 160 being energized by the battery 162. FIG. 4 presents an exemplary display representing a service rig 20 lowering an inner pipe string 62 as represented by arrow 174 of FIG. 4.

Figure 5:
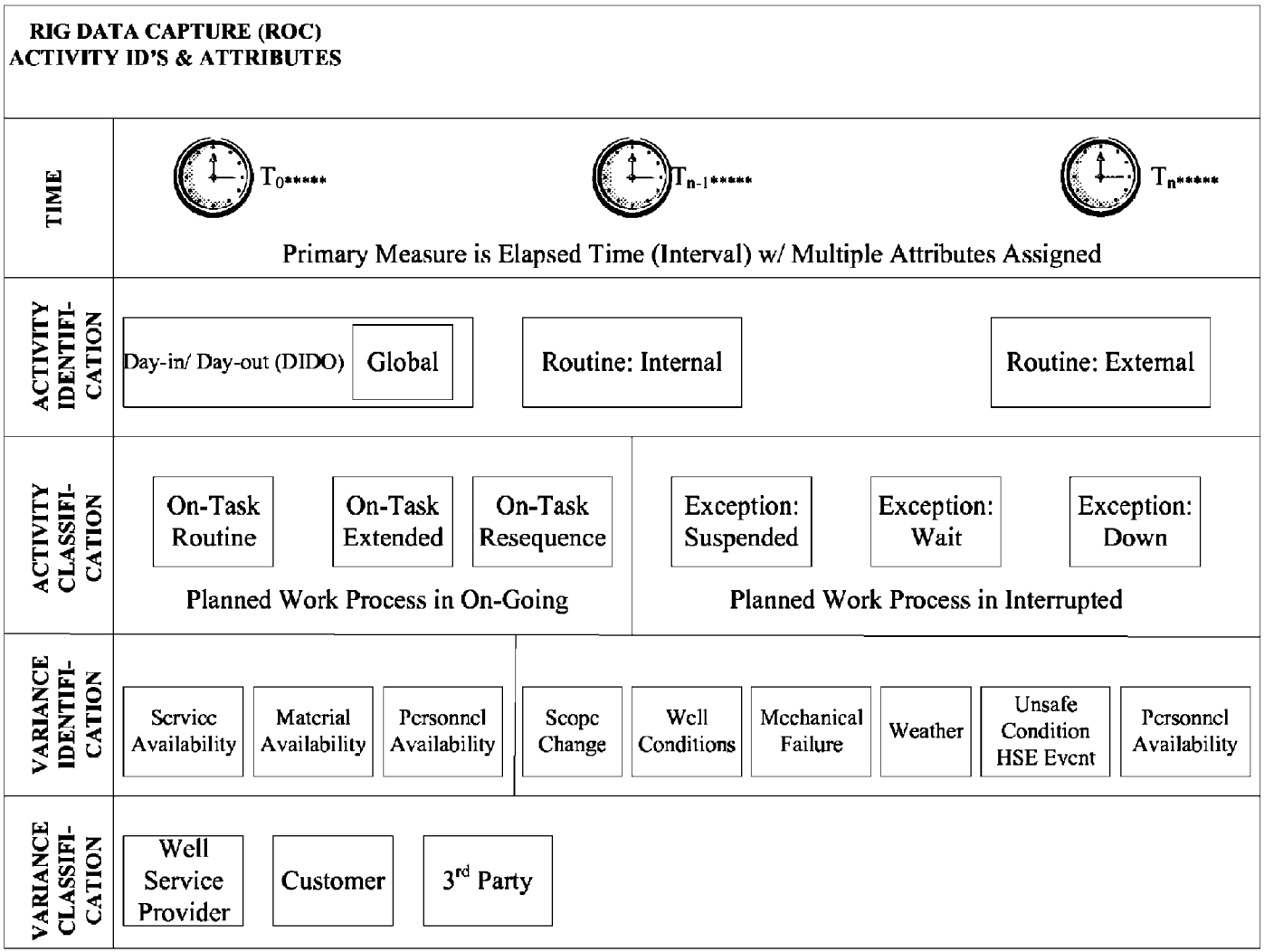
FIG. 5 illustrates one embodiment of an activity capture methodology outlined in tabular form according to one exemplary embodiment of the present invention.

FIG. 5 provides an illustration of an activity capture methodology in tabular form according to one exemplary embodiment of the present invention. Now referring to FIG. 5, an operator first chooses an activity identifier for his/her upcoming task. If "GLOBAL" is chosen, then the operator would choose from rig up/down, pull/run tubing or rods, or laydown/pickup tubing and rods (options not shown in FIG. 6). If "ROUTINE: INTERNAL" is selected, then the operator would choose from rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools. Finally, if "ROUTINE: EXTERNAL" is chosen, the operator would then select an activity that is being performed by a third party, such as rigging up/down third party servicing equipment, well stimulation, cementing, logging, perforating, or inspecting the well, and other common third party servicing tasks. After the activity is identified, it is classified. For all classifications other than "ON TASK: ROUTINE," a variance identifier is selected, and then classified using the variance classification values.

Figure 6:
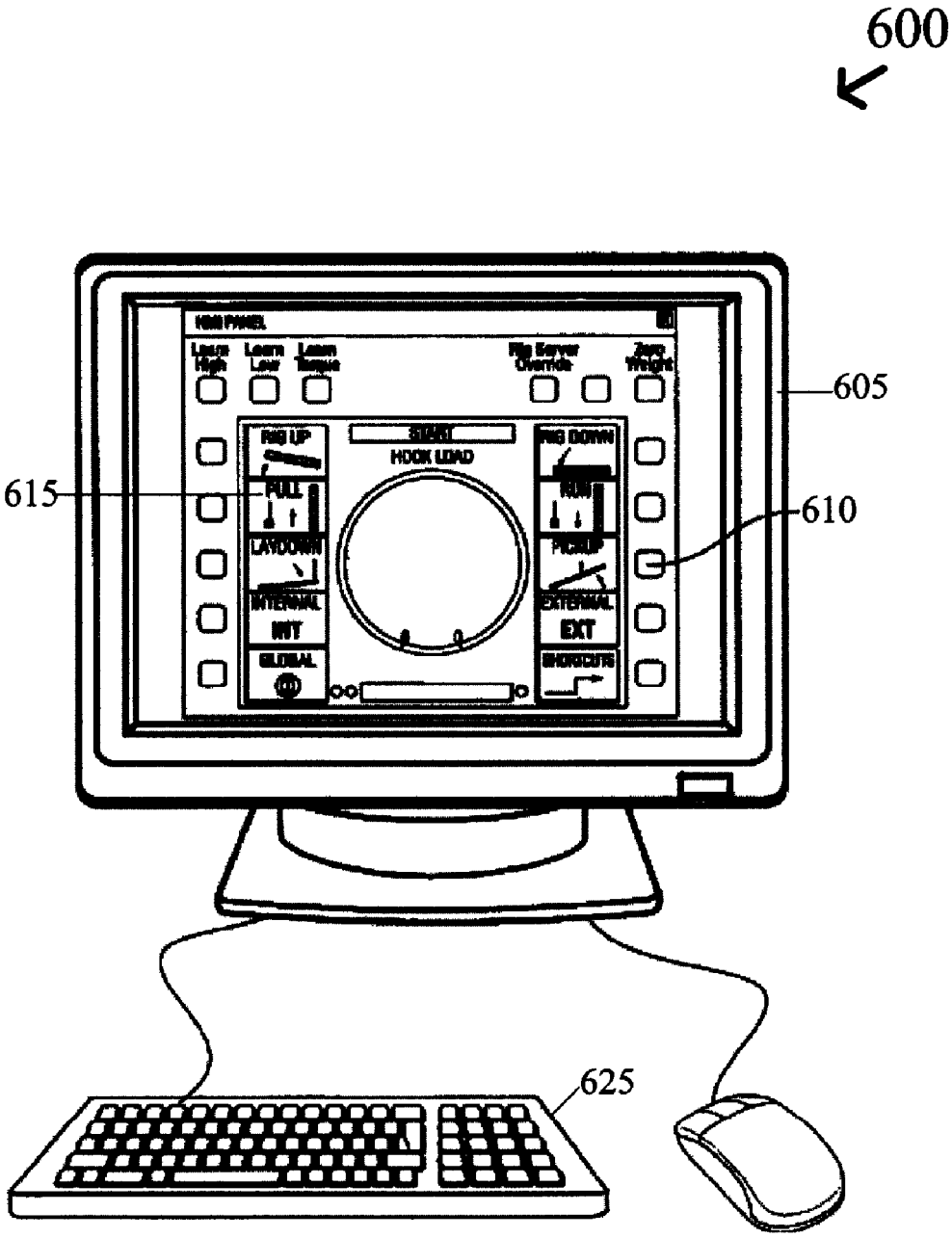
FIG. 6 provides a frontal view of an exemplary operator interface according to one exemplary embodiment of the present invention.

FIG. 6 provides a view of an rig operator interface or supervisor interface according to one exemplary embodiment of the present invention. Now referring to FIG. 6, all that is required from the operator is that he or she input in the activity data into a computer 605. The operator can interface with the computer 605 using a variety of means, including typing on a keyboard 625 or using a touch-screen 610. In one embodiment, a touch-screen display 610 with pre-programmed buttons, such as pulling rods or tubing from a wellbore 615, is provided to the operator, as shown in FIG. 6, which allows the operator to simply select the activity from a group of pre-programmed buttons. For instance, if the operator were presented with the display 610 of FIG. 6 upon arriving at the well site, the operator would first press the "RIG UP" button. The operator would then be presented with the option to select, for example, "SERVICE UNIT," "AUXILIARY SERVICE UNIT," or "THIRD PARTY." The operator then would select whether the activity was on task, or if there was an exception, as described above. In addition, as shown in FIG. 6, prior to pulling (removing) 615 or running (inserting) rods 62, the operator could set the high and low limits for the block 38 by pressing the learn high or learn low buttons after moving the block 38 into the proper position.

Figure 7:
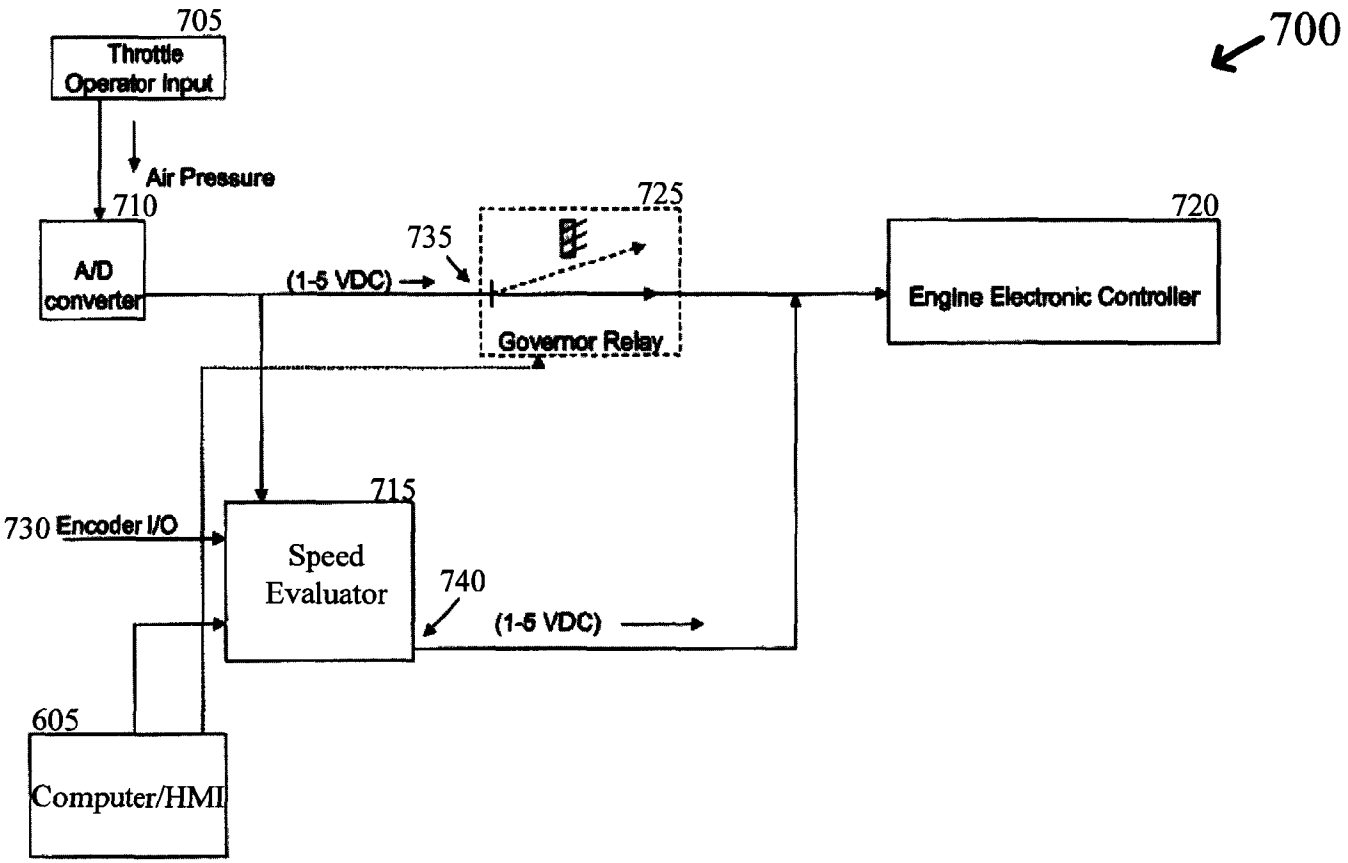
FIG. 7 is a schematic diagram of a system that monitors block speed based on a given task and activates a speed governing feature according to one exemplary embodiment of the present invention.

Turning now to FIG. 7, a schematic diagram of a system for monitoring the block speed for a well service rig based on a given task and regulating the speed of the block 38, through engine speed, if a maximum allowable speed for the task is reached, is presented according to one exemplary embodiment of the present invention. Referring now to FIG. 7, the exemplary system 700 includes a throttle operator input 705, an analog-to-digital converter 710, a speed evaluator 715, the computer 605, an engine controller 720 and a governor relay 725. In one exemplary embodiment, the system is designed to be compatible with electronically controlled engines, such as the engine 26 for the well service rig 20.

The throttle operator input 705 is communicably coupled to the analog-to-digital converter 710. The throttle operator input 705 provides a range of pneumatic pressures, such as between 0-120 pounds per square inch ("psi") of air pressure, to the analog-to-digital converter 710 based on the position in which the rig operator places the throttle for the engine 26. While the present invention is described in terms of providing a pneumatic pressure to designate throttle position, those of ordinary skill in the art will recognize that other methods may be used within the bounds of this invention including, but not limited to, a potentiometer or rheostat type control, which are not shown but are well known in the art. In an alternative embodiment, the throttle position could be determined and a digital signal could be provided by the throttle operator input 705, thereby eliminating the need for the analog-to-digital converter 710.

The analog-to-digital converter 710 is communicably coupled to the throttle operator input 705, the speed evaluator 715, the governor relay 725, and the engine electronic controller 720. In one exemplary embodiment, the analog-to-digital converter 710 generates between one and five volts of direct current based on the input from the throttle operator input 705 to signal the desired operating speed 735 for the engine 26, and thereby the block 38 of the rig 20. The speed evaluator 715 is communicably coupled to the analog-to-digital converter 710, the encoder input 730, the computer 605 and the engine electronic controller 720. The speed evaluator 715 receives a signal representing the speed of the block 38 from the encoder input 730. In one exemplary embodiment, the encoder input 730 is from a traveling block-driven device which can be a drum-driven quad-type encoder, a hall effect sensor mounted near a moving part, such as near the hoist 36, or any other device that will input a proportional signal based on the speed of the block 38 or the hoist 36.

The speed evaluator 715 also receives an input from the computer 605, in the form of the task to be completed. In one exemplary embodiment, the task to be completed or currently being completed is input by the rig operator on the touch-screen 610. In an alternative embodiment, the computer 605 can evaluate several data inputs of the rig 20 to determine the activity being completed at the rig 20 without operator intervention. In addition, the speed evaluator 715 receives an input from the analog-to-digital converter 710 in the form of a one-to-five volt direct current signal representing the throttle position. In one exemplary embodiment, the speed evaluator 715 is a computer, processor, microprocessor or other similar device. The speed evaluator 715 can receive the task to be completed, the current speed of the block 38 and the speed desired by the operator in the form of the throttle operator input 705 and determine if the maximum allowable speed of the block 38, based on the given task, has been reached. The speed evaluator 715 can output a signal 740, in the form of a one to five volt direct current signal, to control the speed of the engine 26, and thereby the speed of the block 38, to the engine electronic controller 720 based on whether the maximum allowable speed has been reached for the given task.

The engine electronic controller 720 is communicably coupled to the governor relay 725, the speed evaluator 715, and the engine 26. In one exemplary embodiment, the engine electronic controller 720 adjusts the fuel-to-air mixture for the engine 26 based on the desired speed of the engine 26, which is determined from external input, such as the analog-to-digital converter 710 or the speed evaluator 715. Once the speed evaluator 715 has determined if the speed should be governed and generated a signal for the speed of the engine 26 based on the several inputs, the engine electronic controller 720 can receive the signal form the speed evaluator 715 and regulate the speed of the engine 26 for the rig 20.

In one exemplary embodiment, the above-described system 700 could act such that, if the desired operating speed from the rig operator 735 is less than the maximum allowable block speed for the rig 20, the speed evaluator 715 would allow the operator, through the throttle operator input 705, to have full control of the block speed through the engine 26. In the alternative, if the desired operating speed from the rig operator 735 is greater than the maximum allowable block speed for the given task, the speed evaluator 715 would send a signal to the engine electronic controller 720 that is different from the signal being sent by the throttle operator input 705, through the analog-to-digital controller 710, that limits the speed of the engine 26, and thereby the speed of the block 38, to the maximum allowable speed.

While not shown, the speed evaluator 715 could also receive a hookload input for the load on the block 38 or the entire load of the rig 20. The hookload input can be generated based on a signal from the hydraulic pad 92 or any other techniques known to those of ordinary skill in the art for measuring hookload or rig load. In the alternative, the rig load or hookload can be determined based on an evaluation of rig load data.

In certain exemplary embodiments, the maximum allowable speed may not only be a function of the task being completed, but may also be adjusted or enforced based on the amount of hookload, rig load, or the amount of tubing 62 in the well 58. For example, when pulling tubing 62 from the well 58, the maximum allowable speed may be set at four feet per second when the hookload is high or there is a lot of tubing 62 still in the well. However, when the hookload is below five thousand pounds or there is less than one thousand feet of tubing 62 in the well 58, the maximum allowable speed can be set at two feet per second.

While not shown in FIG. 7, the system 700 can also include a relief valve, such as an electrical relief valve, in a pressure line to the lock-up actuating cylinder (Not Shown) for the transmission lock-up system. The conventional automatic transmission 32 includes a torque converter that provides slippage between the engine 26 and the transmission. This torque converter allows the engine 26 to build up speed or horsepower while lifting heavy loads. Internal to the transmission 32 is a lock-up system which, in one exemplary embodiment, is a direct coupling mechanical clutch. While lifting the hookload and when the engine speed, in revolutions per minute ("rpm"), matches the transmission input shaft rpm, the transmission 32 no longer needs the torque converter slippage. At this point the transmission 32 engages the lock-up clutch by applying hydraulic pressure to a cylinder, thereby taking the torque converter out of the drive train. In certain situations, the lock-up feature can be dangerous if it is engaged and the rig 20 pulls the tubing 62 into an unexpected obstacle in the well 58, or into the slips, wellhead 186 or a blowout preventer. In these situations, with the lock-up engaged, the momentum of the engine 26 and drive train transfers without slippage to the hoist 36 and increases the chance of pulling the tubing 62 apart. In this embodiment, the speed evaluator 715 can be programmed to disable the lock-up system in the transmission 32 by sending a signal to the electrical relief valve, thereby insuring slippage in the transmission 32.

Figure 8:
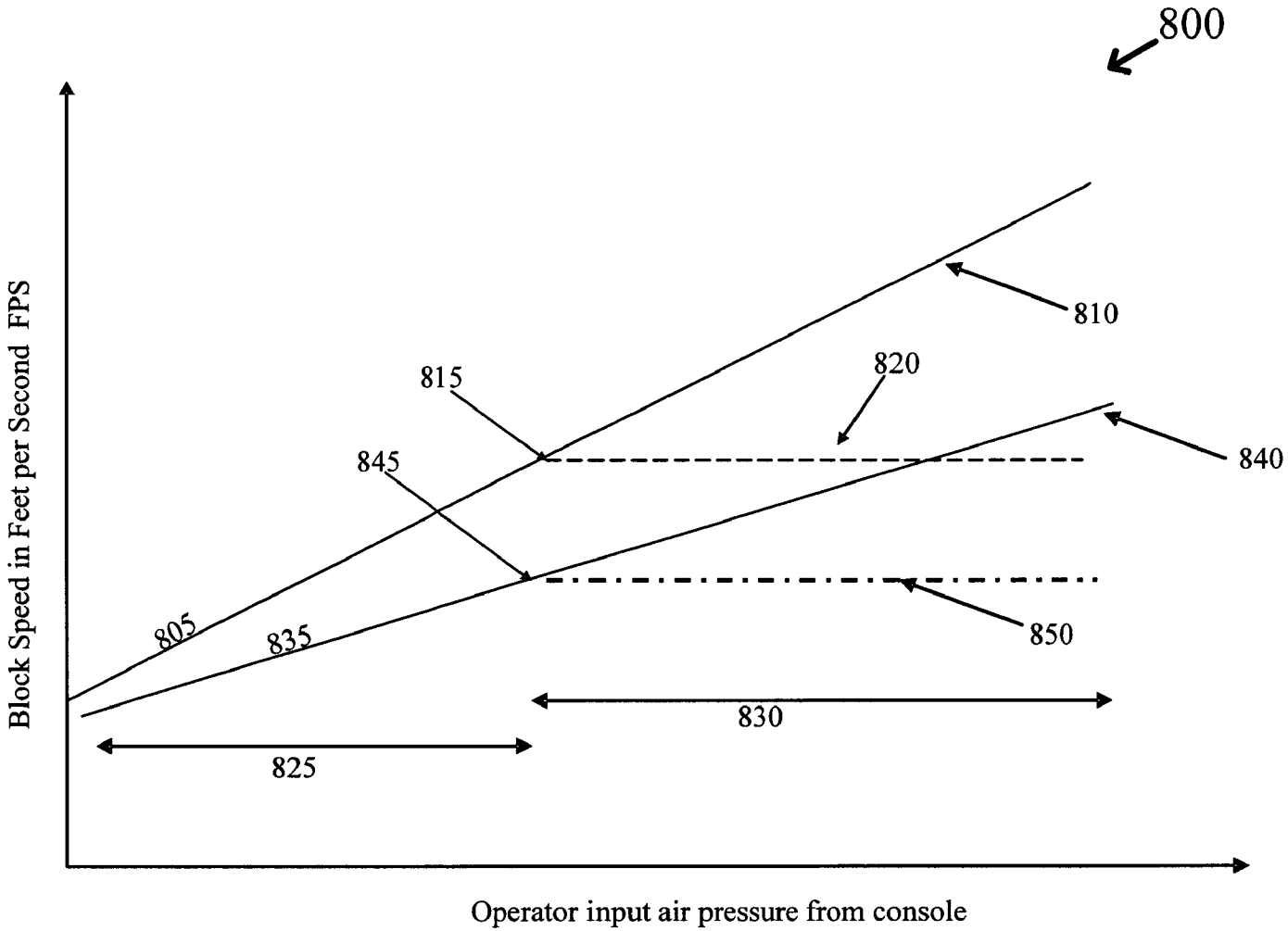
FIG. 8 is an exemplary display of the results of a speed governing feature on the block speed as compared to air pressure based on throttle position according to one exemplary embodiment of the present invention.

FIG. 8 is an illustration of an exemplary display 800 of block speed as compared to throttle position based on the air pressure from the throttle operator imput 705 according to one exemplary embodiment of the present invention. Now referring to FIGS. 1, 4, 7 and 8, the exemplary display 800 includes a block speed chart. The block speed chart includes a series of block speed data points based on, for example, the operator air input pressure from the throttle operator input 705 on the rig 20. While it appears from the chart that the block speed data points are being recorded on a constant basis, it is possible to take the data points at intervals and generate the line or curve based on the averages over a period of data points. The X-axis of the block speed chart 800 represents operator input air pressure from the throttle operator input 705, represented in psi. The Y-axis of the block speed chart 800 represents block speed in feet per second ("FPS").

For the purpose of explanation, the chart 800 includes two exemplary speed curves 805 and 835. Referring to speed curve 805, as air pressure is increased, the block speed has a corresponding increase up to point 815, where the speed evaluator 715 begins to govern the speed of the block 38 due to the fact that the maximum allowable speed has been reached for the given task. After point 815, as air pressure continues to increase based on the throttle operator input 705, the speed curve 805 is represented by two separate curves, curve 810, which represents the speed the block 38 would achieve without activating the speed governing feature, and curve 820, which represents the speed of the block 38 being maintained at the maximum allowable speed for that task even though the air pressure continues to increase.

In another example, referring to speed curve 835, as air pressure is increased, the block speed has a corresponding increase up to point 845, where the speed evaluator 715 begins to govern the speed of the block 38 due to the fact that the maximum allowable speed has been reached for the given task. After point 845, as air pressure continues to increase, based on the throttle operator input 705, the speed curve 835 is represented by two separate curves, curve 840, which represents the speed the block 38 would achieve without activating the speed governing feature, and curve 850, which represents the speed of the block 38 being maintained at the maximum allowable speed for that task even though the air pressure continues to increase. Based on the block speed curves 805 and 835 for the chart 800, in the pressure range 825, the operator would have full control of the speed of the blocks 38. However, in the pressure range 830, the operator would only have control of the block speed below the maximum allowable speed. Any attempt by the operator to increase the block speed will result in the block 38 continuing to operate at the maximum allowable speed.

Processes of exemplary embodiments of the present invention will now be discussed with reference to FIGS. 9 and 10. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention. Furthermore, while the present invention will be described for exemplary purposes in relation to a well service rig 20, it should be understood that the processes are not limited to use with the rig 20 but can be employed with other types of well-related machinery and in environments outside the well service or well related industry.

Figure 9:
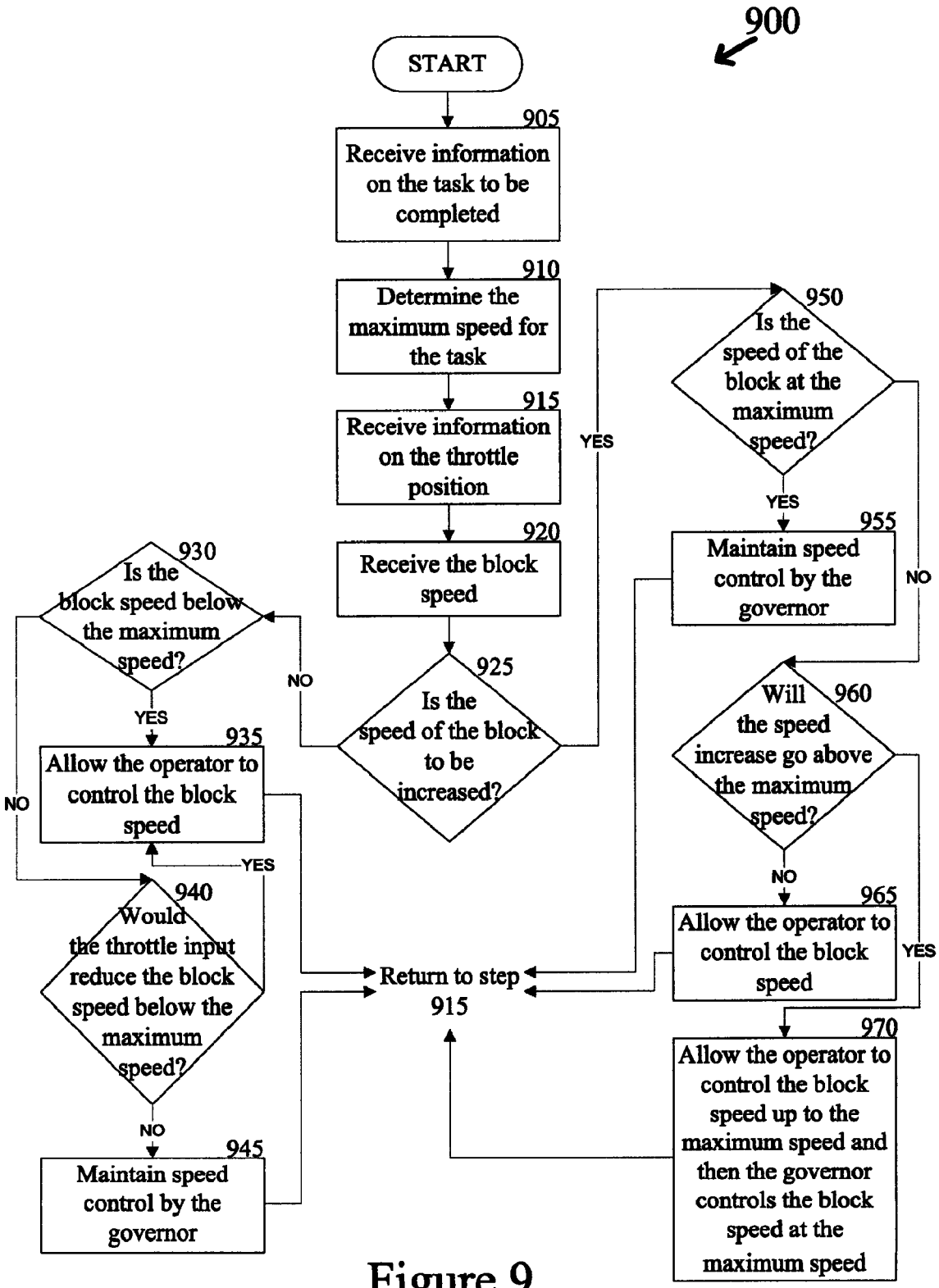
FIG. 9 is a logical flowchart diagram presenting the steps of an exemplary process for limiting the maximum block speed based on the task to be completed in accordance with one exemplary embodiment of the present invention.

Turning now to FIG. 9, a logical flowchart diagram illustrating an exemplary method 900 for limiting the maximum block speed based on the task to be completed is presented according to one exemplary embodiment of the present invention. Referring to FIGS. 1, 4, 6, 7, and 9, the exemplary method 900 begins at the START step and continues to step 905, where information on the task to be completed or that is being completed is received. In one exemplary embodiment, the task is entered by the operator at the computer 605 using the touch-screen 610. For example, prior to pulling tubing 62 the rig operator could select the pull option 615 at the computer 605. In an alternative embodiment, the computer 605 can evaluate several data inputs of the rig 20 to determine the activity being completed at the rig 20 without operator intervention.

In step 910, the maximum allowable speed for the task is determined. In one exemplary embodiment, the maximum allowable speed for each task is a predetermined amount stored in the computer 605 and/or the speed evaluator 715. In an alternative embodiment, the maximum allowable speed can be received as an input from the operator at the computer 605 on the rig 20. While the exemplary embodiment is described as a maximum allowable speed, each task may have one or more maximum allowable speed limits based on different conditions, such as rig load, hookload, well conditions, amount of tubing 62, rods or other tubulars remaining in the well 58, the type of equipment used in the operation, such as the type of rig 20, or other factors known to those of ordinary skill in the art. For example, a rig 20 pulling tubing 62 from the well 58 may generally have a maximum allowable speed of four feet per second. However, once there is less than five thousand pounds of hookload and or approximately one thousand linear feet of tubing 62 remaining in the well 58, the maximum allowable speed can be reset at two feet per minute. In another example, a rig 20 pulling rods from the well 58 may generally have a maximum allowable speed of eight feet per second. However, once there is less than five thousand pounds of hookload and or approximately two thousand linear feet of rods 62 remaining in the well 58, the maximum allowable speed can be reset at three feet per minute. Furthermore, the maximum allowable speed may be constructed so that it is adjustable at the computer 605 or the speed evaluator 715. The adjustability of the maximum allowable speeds can be based on customer requirements, current conditions, or the experience of the rig operator.

The throttle position is received in step 915. In one exemplary embodiment, the throttle position is received from the throttle operator input 705 through the analog-to-digital converter 710 at the speed evaluator 715. In step 920, the speed evaluator 715 receives the block 38 speed. In one exemplary embodiment, the block 38 speed is received from a drum-driven quad-type encoder at the hoist 36, a hall effect sensor mounted adjacent a moving part between the hoist 36 and the block 38, or any other device that provides an input proportional signal based on the speed of the block 38 or the hoist 36. In step 925, an inquiry is conducted to determine if the speed of the block 38 is to be increased based on the throttle operator input 705. If not, the "NO" branch is followed to step 930.

In step 930, an inquiry is conducted to determine if the block speed is below the maximum allowable speed. In one exemplary embodiment, this determination can be made at the speed evaluator 715 by comparing the current input from the encoder 730 to the stored maximum allowable speed for the task being completed. If the speed is currently below the maximum allowable speed, the "YES" branch is followed to step 935, where the operator of the rig 20 is given full control of the block speed. The process can then return from step 935 to step 915 to continue analyzing the throttle position. On the other hand, if the block speed is not currently below the maximum allowable speed, the "NO" branch is followed to step 940.

In step 940, an inquiry is conducted to determine if the throttle input would reduce the block speed below the maximum allowable speed. If not, the "NO" branch is followed to step 945, where the governor relay 725 remains activated and the speed is maintained at the maximum allowable speed. At this point, the operator does not have full range of control of the block speed. The process returns from step 945 to step 915 to continue monitoring the throttle position. Returning to step 940, if the throttle input would reduce the block speed below the maximum allowable speed, the "YES" branch is followed to step 935, where the governor relay 725 is deactivated once the speed of the engine 26 drops so that the speed of the block 38 will be below the maximum allowable speed and the operator is given control of the block speed below the maximum allowable speed. The process returns from step 935 to step 915 to continue analyzing the throttle position.

Returning to step 925, if the speed of the block 38 is being increased based on the throttle position, the "YES" branch is followed to step 950. In step 950, an inquiry is conducted to determine if the speed of the block 38 is currently at the maximum allowable speed. If so, the "YES" branch is followed to step 955, where the governor relay 725 is maintained in the activated position and the speed of the block 38 is maintained at the maximum allowable speed. On the other hand, if the speed of the block 38 is not currently at the maximum allowable speed, the "NO" branch is followed to step 960. In step 960, an inquiry is conducted to determine if the speed increase requested by the operator based on throttle position takes the speed of the block 38 above the maximum allowable speed. If not, the "NO" branch is followed to step 965, where the operator is allowed to freely control the speed of the block 38 through the use of the throttle. The process continues from step 965 to step 915 to continue monitoring the throttle position. On the other hand, if the speed of the block reach the maximum allowable speed and will exceed it based on the throttle position, the "YES" branch is followed to step 970. In step 970, the operator is allowed to control the block speed through the throttle up to the maximum allowable speed. Once the maximum allowable speed is reached, the governor relay 725 is activated and the speed evaluator 715 sends a signal 740 to the engine electronic controller 720 that maintains the speed of the block 38 at the maximum allowable speed. The process continues to step 915 to continue monitoring the throttle position.

Figure 10:
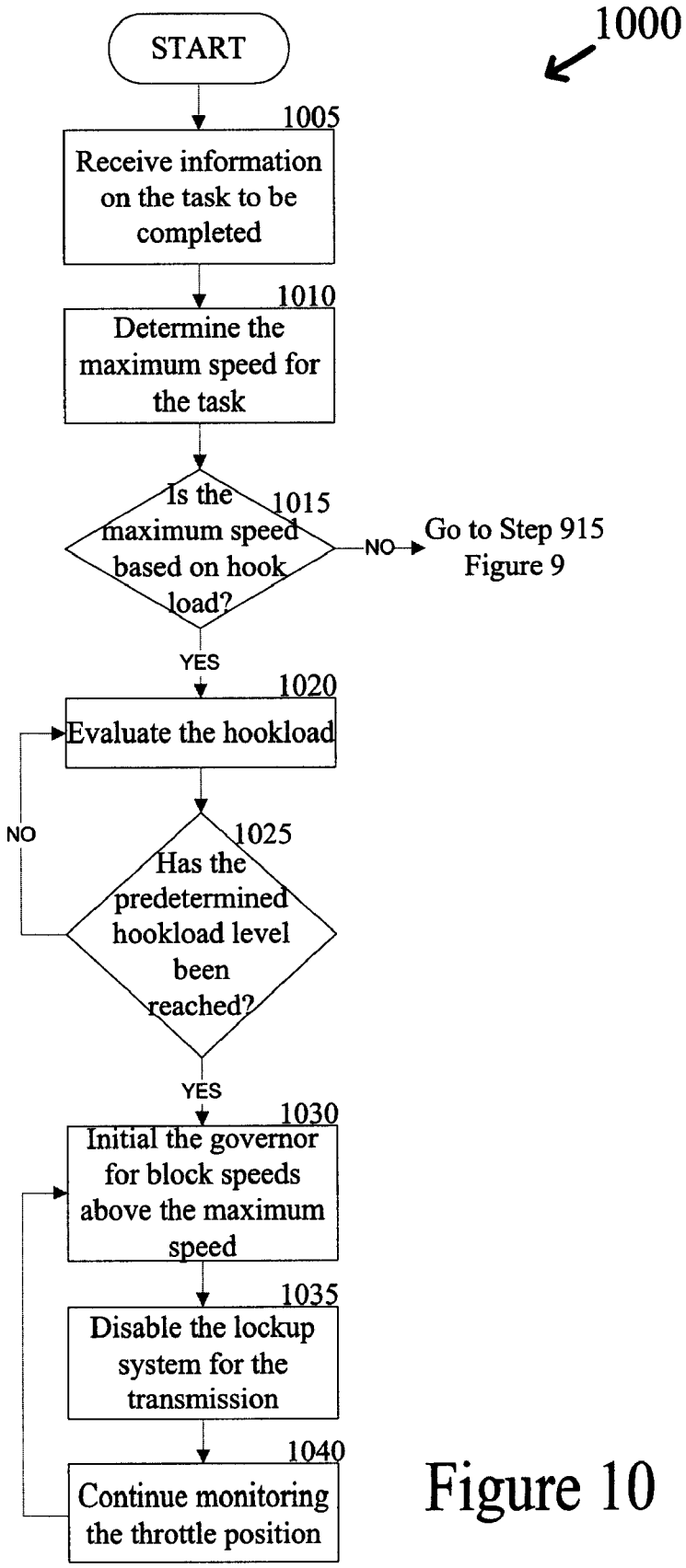
FIG. 10 is a logical flowchart diagram presenting the steps of an exemplary process for limiting the maximum block speed and disabling the lock-up system for a transmission based on the task to be completed and the load on the system in accordance with one exemplary embodiment of the present invention.

FIG. 10, a logical flowchart diagram illustrating an exemplary method 1000 for limiting the maximum block speed and disabling the lock-up system for the transmission 32 based on the task to be completed and the load on the rig 20 presented according to one exemplary embodiment of the present invention. Referring to FIGS. 1, 4, 6, 7, 9, and 10, the exemplary method 1000 begins at the START step and continues to step 1005, where information on the task to be completed or that is being completed is received. In one exemplary embodiment, the task is entered by the operator at the computer 605 using the touch-screen 610. For example, prior to pulling tubing 62 the rig operator could select the pull option 615 at the computer 605. In an alternative embodiment, the computer 605 can evaluate several data inputs of the rig 20 to determine the activity being completed at the rig 20 without operator intervention.

In step 1010, the maximum allowable speed for the task is determined. In one exemplary embodiment, the maximum allowable speed for each task is a predetermined amount stored in the computer 605 and/or the speed evaluator 715. In an alternative embodiment, the maximum allowable speed can be received as an input from the operator at the computer 605 on the rig 20. While the exemplary embodiment is described as a maximum allowable speed, each task may have one or more maximum allowable speed limits based on different conditions, such as rig load, hookload, well conditions, amount of tubing 62, rods or other tubulars remaining in the well 58, the type of equipment used in the operation, such as the type of rig 20, or other factors known to those of ordinary skill in the art.

In step 1015, an inquiry is conducted to determine if the maximum allowable speed is based on the rig load or the hookload for the rig 20. If not, the "NO" branch is followed to step 915 of FIG. 9 and the process follows that as substantially described in FIG. 9. Otherwise, the "YES" branch is followed to step 1020, where the hookload or rig load is evaluated. The hookload or rig load can be generated based on a signal from the hydraulic pad 92 or any other techniques known to those of ordinary skill in the art for measuring hookload or rig load, such as other types of load gauges including, but not limited to, strain gauges, line indicators and the like. In the alternative, the rig load or hookload can be determined based on an evaluation of rig load data. The load information can be received at the computer 605 and/or the speed evaluator 715 for analysis and comparison to the maximum allowable speed.

In step 1025, an inquiry is conducted to determine if a predetermined hookload or rig load has been reached. For example, as described above, when the rig 20 is pulling tubing 62 from the well 58, the maximum allowable speed can be reduced from four feet per second to two feet per second when the hookload falls below five thousand pounds. If the predetermined hookload or rig load has not been reached, the "NO" branch is followed back to step 1020 to continue evaluation of the hookload. On the other hand, if the predetermined hookload or rig load level has been reached, the "YES" branch is followed to step 1030, where the upper level of the block speed is limited to the maximum allowable speed when the operator tries to speed up the block 38 above the maximum allowable speed. The process of maintaining block speed at or below the maximum allowable speed is substantially as described in FIG. 9. In step 1035, the speed evaluator 715 can transmit a signal to disable the lock-up system for the transmission. In one exemplary embodiment, the signal can activate a relief valve, such as an electrical relief valve, in a pressure line to the lock-up actuating cylinder for the transmission lock-up system. In step 1040, the speed evaluator 715 continues to monitor the throttle position through the throttle operator input 705 to determine if the block speed needs to be limited to the maximum allowable speed. The process continues from step 1040 to step 1030 for further evaluation of the throttle position as compared to the maximum allowable speed for the task and rig load or hookload.

Although the invention is described with reference to preferred embodiments, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those or ordinary skill in the art, and ways of constructing other embodiments of the present invention will suggest themselves to practitioners of the art. Therefore, the scope of the present invention is to be limited only by any claims that follow.

I claim:

1. A method for controlling speed of a block on a rig comprising:

receiving a block speed;

receiving a throttle input, wherein the throttle input generates a change in the block speed;

determining if the throttle input would generate a change in the block speed, wherein the block speed would be above a maximum allowable speed for the block; and limiting the block speed to be substantially equal to the maximum allowable speed based on a positive determination that the throttle input would generate a change in the block speed, wherein the block speed would be above the maximum allowable speed.

2. The method of claim 1, further comprising the steps of:

accepting a task to be completed by the rig; and determining the maximum allowable speed based on the task to be completed by the rig.

3. The method of claim 1, further comprising the steps of:

determining a task being completed by the rig; and determining the maximum allowable speed based on the task being completed by the rig.

4. The method of claim 3, wherein the task is determined based on an evaluation of a rig load chart comprising rig load data.

5. The method of claim 1, further comprising the step of allowing the throttle input to control the block speed based on a negative determination that the throttle input would generate a change in the block speed, wherein the block speed would be above the maximum allowable speed.

6. The method of claim 1, further comprising the steps of:

accepting a task to be completed by the rig;

accepting a predetermined hookload weight; and determining the maximum allowable speed based on the task being completed and the predetermined hookload weight.

7. The method of claim 6, further comprising the steps of:

receiving a current hookload weight;

determining if the current hookload weight is less than the predetermined hookload weight;

determining if the throttle input would generate a change in the block speed, wherein the block speed would be above the maximum allowable speed; and preventing the throttle input from increasing the block speed above the maximum allowable speed based on a positive determination that the current hookload weight is less than the predetermined hookload weight.

8. The method of claim 1, further comprising the steps of:

accepting a task to be completed;

accepting a predetermined equipment length; and determining the maximum allowable speed based on the task being completed and the predetermined equipment length.

9. The method of claim 8, further comprising the steps of:

receiving a current equipment length;

determining if the current equipment length is less than the predetermined equipment length;

determining if the throttle input would generate a change in the block speed, wherein the block speed would be above the maximum allowable speed; and preventing the throttle input from increasing the block speed above the maximum allowable speed based on a positive determination that the current equipment length is less than the predetermined equipment length.

10. A computer-readable medium comprising computer-executable instructions for performing the steps required in claim 1.

11. A method for controlling speed of a block on a well service rig comprising:

accepting a task being completed by the rig;

determining a maximum allowable speed for the block based on the task;

accepting a throttle input, wherein the throttle input generates a change in the block speed;

accepting a current block speed;

determining if the throttle input would generate a change in the current block speed, wherein the current block speed would be above the maximum allowable speed for the block; and limiting the block speed to be about equal to the maximum allowable speed based on a positive determination that the throttle input would generate a change in the current block speed, wherein the current block speed would be above the maximum allowable speed.

12. The method of claim 11, further comprising the step of allowing the throttle input to control the block speed based on a negative determination that the throttle input would generate a change in the current block speed, wherein the current block speed would be above the maximum allowable speed.

13. The method of claim 11, further comprising the steps of:

accepting a predetermined hookload weight;

determining the maximum allowable speed based on the task being completed and the predetermined hookload weight;

receiving a current hookload weight;

determining if the current hookload weight is less than the predetermined hookload weight;

determining if the throttle input would generate a change in the current block speed, wherein the current block speed would be above the maximum allowable speed; and preventing the throttle input from increasing the block speed above the maximum allowable speed based on a positive determination that the current hookload weight is less than the predetermined hookload weight.

14. The method of claim 13, further comprising the step of disabling the lock-up system for a transmission driving the block based on a positive determination that the current hookload weight is less than the predetermined hookload weight.

15. The method of claim 11, further comprising the steps of:

accepting a predetermined tubular length;

determining the maximum allowable speed based on the task being completed and the predetermined tubular length;

receiving a current tubular length;

determining if the current tubular length is less than the predetermined tubular length;

determining if the throttle input would generate a change in the current block speed, wherein the current block speed would be above the maximum allowable speed; and preventing the throttle input from increasing the block speed above the maximum allowable speed based on a positive determination that the current tubular length is less than the predetermined tubular length.

16. The method of claim 15, further comprising the step of disabling the lock-up system for a transmission driving the block based on a positive determination that the current tubular length is less than the predetermined tubular length.

17. A computer-readable medium comprising computer-executable instructions for performing the steps required in claim 11.

18. A method for controlling speed of a block on a well service rig comprising:

accepting a task being completed by the rig;

accepting a predetermined hookload weight;

determining the maximum allowable speed based on the task being completed and the current hookload weight;

accepting a throttle input, wherein the throttle input generates a change in the block speed;

accepting a current hookload weight;

determining if the current hookload weight is less than the predetermined hookload weight;

preventing the throttle input from increasing the block speed above the maximum allowable speed based on a positive determination that the current hookload weight is less than the predetermined hookload weight.

19. A computer-readable medium comprising computer-executable instructions for performing the steps required in claim 18.

20. A system for controlling speed of a block on a well service rig comprising:

a throttle sensor;

a block speed sensor;

a task input display;

an engine electronic controller; and a speed evaluator.

21. The system of claim 20, wherein the throttle sensor comprises:

a throttle input generating a variable pneumatic pressure based on positioning of the throttle input; and an analog-to-digital converter for receiving the variable pneumatic pressure and converting the variable pneumatic pressure into a corresponding voltage.

22. The system of claim 20, wherein the block speed sensor comprises an encoder.

23. The system of claim 20, wherein the speed evaluator receives a voltage from the throttle, a speed value from the block speed sensor, and a task being completed by the well service rig from the task input display.

24. The system of claim 23, wherein the speed evaluator determines a maximum allowable speed based on the task; and transmits a signal comprising a speed voltage to the engine electronic controller based on the maximum allowable speed, the voltage and the speed value.

25. The system of claim 24, wherein the speed voltage is less than the voltage if the speed value is greater than or equal to the maximum speed.

* * * * *